US006810815B2

(12) United States Patent
Mueller-Fiedler et al.

(10) Patent No.: US 6,810,815 B2
(45) Date of Patent: Nov. 2, 2004

(54) BRIDGE IGNITER

(75) Inventors: Roland Mueller-Fiedler, Leonberg (DE); Winfried Bernhard, Gerlingen (DE); Ulrich Kunz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/296,686

(22) PCT Filed: Mar. 21, 2002

(86) PCT No.: PCT/DE02/01022

§ 371 (c)(1),
(2), (4) Date: Apr. 15, 2003

(87) PCT Pub. No.: WO02/079713

PCT Pub. Date: Oct. 10, 2002

(65) Prior Publication Data

US 2003/0164106 A1 Sep. 4, 2003

(30) Foreign Application Priority Data

Mar. 31, 2001 (DE) ..... 101 16 189

(51) Int. Cl.[7] ..... F42B 3/10
(52) U.S. Cl. ..... 102/202.5
(58) Field of Search ..... 102/205.5, 202.7, 102/202.4

(56) References Cited

U.S. PATENT DOCUMENTS

| | | | | | |
|---|---|---|---|---|---|
| 3,669,022 | A | * | 6/1972 | Dahn et al. | 102/206 |
| 3,882,323 | A | * | 5/1975 | Smolker | 327/525 |
| 4,484,960 | A | * | 11/1984 | Rucker | 149/22 |
| 4,585,529 | A | * | 4/1986 | Kanda et al. | 205/154 |
| 4,602,565 | A | * | 7/1986 | MacDonald et al. | 102/202.7 |
| 4,729,315 | A | * | 3/1988 | Proffit et al. | 102/202.9 |
| 4,819,560 | A | * | 4/1989 | Patz et al. | 102/202.5 |
| 4,862,803 | A | * | 9/1989 | Nerheim et al. | 102/202.5 |
| 4,893,563 | A | * | 1/1990 | Baginski | 102/202.2 |
| 4,976,200 | A | * | 12/1990 | Benson et al. | 102/202.7 |
| 5,074,035 | A | * | 12/1991 | Tyznik | 29/830 |
| 5,080,016 | A | * | 1/1992 | Osher | 102/202.7 |
| 5,090,322 | A | * | 2/1992 | Allford | 102/202.7 |
| 5,370,053 | A | * | 12/1994 | Williams et al. | 102/202.5 |
| 5,385,097 | A | * | 1/1995 | Hruska et al. | 102/202.5 |
| 5,479,860 | A | * | 1/1996 | Ellis | 102/313 |
| 5,544,585 | A | * | 8/1996 | Duguet | 102/202.5 |
| 5,682,008 | A | * | 10/1997 | Chervinsky et al. | 102/202.7 |
| 5,732,634 | A | * | 3/1998 | Flickinger et al. | 102/202.5 |
| 5,831,203 | A | * | 11/1998 | Ewick | 102/202.5 |
| 5,847,309 | A | * | 12/1998 | Baginski | 102/202.2 |
| 6,158,347 | A | * | 12/2000 | Neyer et al. | 102/202.7 |

(List continued on next page.)

FOREIGN PATENT DOCUMENTS

| | | |
|---|---|---|
| CH | 649 150 | 4/1985 |
| DE | 27 01 373 | 8/1978 |
| DE | 197 32 380 | 2/1999 |
| DE | 199 40 201 | 1/2001 |
| EP | 0 112 245 | 6/1984 |
| EP | 0 314 898 | 5/1989 |
| EP | 05 10 551 | 4/1992 |
| FR | 2 704 944 | 11/1994 |
| GB | 2 224 729 | 5/1990 |

*Primary Examiner*—Michael J. Carone
*Assistant Examiner*—Jordan Lofdahl
(74) *Attorney, Agent, or Firm*—Kenyon & Kenyon

(57) ABSTRACT

A bridge igniter having a resistance layer which has a given electrical resistance and which can be heated by an electrical current, an electrical insulating layer that is disposed on the resistance layer and has a given thermal conductivity, a reactive layer that is disposed on the insulating layer, the insulating layer transmitting the heat that is produced in the resistance layer to the reactive layer, thereby causing the latter to undergo an exothermic reaction, and a pyrotechnic layer that is disposed on or above the reactive layer and that may be set off by the exothermic reaction of the reactive layer.

25 Claims, 2 Drawing Sheets

U.S. PATENT DOCUMENTS 6,178,888 B1 * 1/2001 Neyer et al. ..... 102/202.7
6,199,484 B1 * 3/2001 Martinez-Tovar et al. ..... 102/202.4
6,234,081 B1 * 5/2001 Neyer ..... 102/202.5
6,269,745 B1 * 8/2001 Cieplik et al. ..... 102/202.5
6,327,978 B1 * 12/2001 Turano et al. ..... 102/202.7
6,354,217 B1 * 3/2002 Narumi et al. ..... 102/202.7
6,408,758 B1 * 6/2002 Duguet ..... 102/202.2
6,553,911 B1 * 4/2003 Walker et al. ..... 102/202.7

* cited by examiner

BRIDGE IGNITER

FIELD OF THE INVENTION

The present invention relates to a bridge igniter, such as, for example, a reactive bridge igniter.

Although applicable to any bridge igniter, the present invention and the set of problems on which it is based are explained in relation to a bridge igniter for triggering airbags and seat-belt tighteners in motor vehicles.

BACKGROUND INFORMATION

Bridge igniters may be made up of a resistance layer and a reactive layer disposed on top of it, the resistance layer being heated using an electric current. The reactive layer, also heated, may react exothermically and initiate a pyrotechnic material lying on top of it.

The electrical resistance of the bridge igniter or of the resistance layer may not be adjusted independently of the material of the reactive layer or its thickness, because these two layers are in electrical contact with each other. Thus, a greater energy input may be required to generate the Joule-effect heat required to fire the reactive bridge igniter.

Moreover, under certain circumstances, several adhesive layers may be required between the resistance layer and the reactive layer for an improved mechanical adhesion, which may also increase the process costs.

A metal ignition bridge that is separated from a pyrotechnic ignition charge by an insulating layer is discussed in European Published Application Patent No. 05 10 551. The pyrotechnic ignition charge is started by heating the metal ignition bridge. An adhesive layer for the hybrid bonding of two substrates is discussed from German Published Patent Application No. 27 01 373. Swiss Published Patent Application No. 649 150 discusses an insulating layer that separates the pyrotechnic ignition charge from the metal ignition bridge. In this manner, the complete ignition resistance may also be joined to the substrate. An ignition element for pyrotechnic payloads and a corresponding method are discussed in German Published Patent Application No. 197 32 380. This may specify that electrical contact surfaces are connected to the resistance layer to supply electricity to it. It may also be indicated therein that the resistance layer is configured in the shape of a bridge. A pyrotechnic ignition system having an integrated ignition circuit is discussed in German Patent Publication 199 40 201. This may specify that the bridge igniter is disposed on a substrate. This substrate may also be an integrated circuit that supplies electrical energy to the resistance layer.

SUMMARY OF THE INVENTION

An object of the present invention may include providing bridge igniters which may minimize the energy input required to fire the pyrotechnic material and at the same time may allow the ignition bridge resistance to be adjusted over a greater range, independent of the thickness of the reactive layer.

According to an exemplary embodiment of the present invention, the bridge igniter may have: a resistance layer which has a given electrical resistance and which may be heated by an electrical current, an electrically insulating layer that is disposed on the resistance layer and has a given thermal conductivity, a reactive layer that is disposed on the insulating layer, the insulating layer transmitting the heat that is produced in the resistance layer to the reactive layer, thereby causing the latter to undergo an exothermic reaction, and a pyrotechnic layer that is disposed on or above the reactive layer and may be set off by the exothermic reaction of the reactive layer.

According to an exemplary bridge igniter of the present invention, the resistance of the bridge may be adjustable over a greater range and may be independent of the reactive layer material and its thickness. Thus, the electrical resistance of the resistance layer may be the sole factor determining the energy input required to fire the bridge igniter. The electrical separation of resistance layer and reactive layer by the insulating layer may allow the electrical resistance of the resistance layer to be adjusted independently of the material characteristics and thickness of the reactive layer.

Moreover, the insulating layer may simultaneously function as an adhesive layer between the resistance layer and the reactive layer. Additional production steps for forming such an adhesive layer may be eliminated.

Moreover, the insulating layer may be used as a diffusion barrier between the resistance layer and the reactive layer, a diffusion of atoms and/or ions of the reactive layer material into the resistance material, for example, thereby being prevented.

According to an exemplary embodiment, the insulating layer may be formed as an oxide layer, such as, for example, as a copper oxide or silicon dioxide layer. These layers, which may have a given thickness, may simultaneously ensure a good electrical insulation and a thermal connection between the resistance layer and the reactive layer.

According to another exemplary embodiment, the insulating layer may have a thickness of approximately 50 to 100 nm. Such thicknesses may be required to be adapted to the corresponding materials in such a manner that they fulfill the given characteristics.

According to another exemplary embodiment, the resistance layer may be made of palladium or nickel-chromium.

According to another exemplary embodiment, the reactive layer may be made of zirconium or hafnium.

According to another exemplary embodiment, the resistance layer has an adhesive layer, for example, a titanium layer, disposed on it. This adhesive layer may provide a better mechanical adhesion of the reactive layer or the insulating layer on the resistance layer. For example, the insulating layer itself may function as an adhesive layer between the resistance layer and the reactive layer. Consequently, the step of manufacturing an additional adhesive layer may be omitted.

According to another exemplary embodiment, a co-reactant may cooperate with the reactive layer to produce an exothermic reaction in it. As a result, an additional amount of heat may be released which may be required to set off the pyrotechnic material.

According to another exemplary embodiment, the insulating layer may function as a co-reactant. The reactive layer may reacts exothermically when it cooperates with an oxide layer, for example. Thus, no additional co-reactants may have to be produced.

According to another exemplary embodiment, the reactive layer may have a co-reactant, such as, for example, an oxide layer, disposed on it. This co-reactant may also be used to initiate an exothermic reaction in the reactive layer.

Another exemplary embodiment may provide a plurality of reactive layers and co-reactants in alternating sequence to produce a multi-layer structure, the co-reactants being formed in particular as oxide layers of the material of the corresponding reactive layers. This may result in a sandwich-type structure, which may contribute to improving the course of the reaction by enlarging the reaction surface.

According to another exemplary embodiment, the insulating layer may function as a diffusion barrier between the resistance layer and the reactive layer.

According to another exemplary embodiment, electrical contact surfaces, for example, gold plates, may be connected to the resistance layer in order to supply electricity to it. The size, shape and material of the contact surfaces may be adapted to a desired electrical energy to be supplied.

According to another exemplary embodiment, the bridge igniter may be disposed on a substrate, for example, a silicon substrate, a ceramic, a plastic or an integrated circuit (IC). When the bridge igniter is disposed on an integrated circuit, the contact surfaces may not be required, because the resistance layer may be supplied with electrical energy via supply leads of the integrated circuit. Thus, the overall structure may be simplified and a more compact component may be produced.

According to another exemplary embodiment, the resistance layer may be configured in the shape of a bridge. As a result, the resistance of the resistance layer may be increased and more Joule-effect heat may be generated.

DETAILED DESCRIPTION

In the figures, the same reference numbers designate the same or functionally equivalent components.

Figure 1:
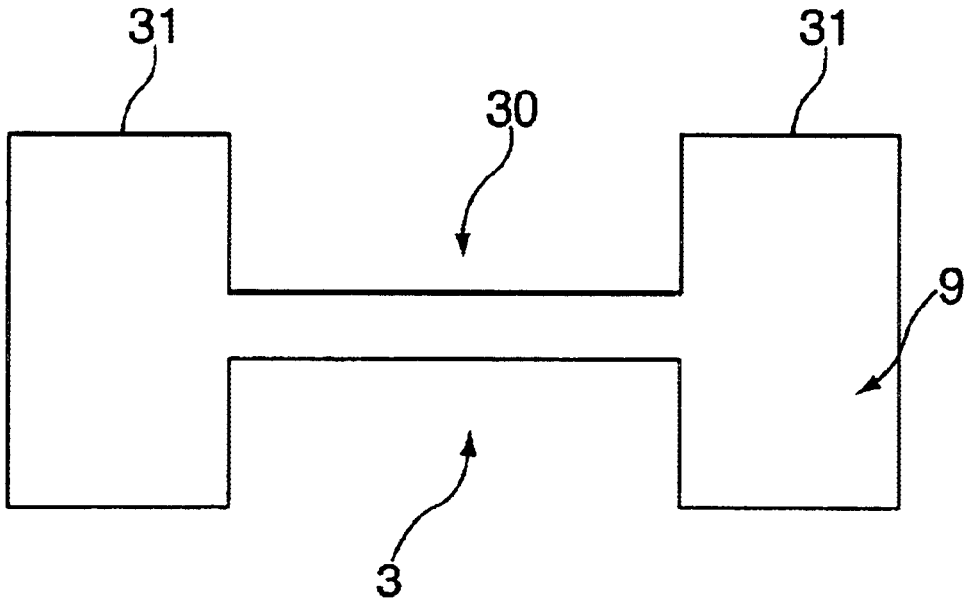
FIG. 1 shows a top view of a resistance layer of a bridge igniter according to a first exemplary embodiment of the present invention.

FIG. 1 illustrates a top view of a resistance layer 3 of a bridge igniter 1 according to a first exemplary embodiment of the present invention.

Resistance layer 3 is configured with an "H" shape and has a central bridge that connects two rectangular-shaped areas 31 to each other. It may be made of palladium or nickel chromium. Palladium has a relatively poor adhesion characteristic, so that an adhesion layer 9 may be disposed on resistance layer 3 for a better mechanical adhesion of insulating layer 4 or reactive layer 5 to the resistance layer.

Bridge 30 may have a thickness of approximately 100 nm to 150 nm and width or length dimensions of approximately 30 $\mu$m to 60 $\mu$m.

Figure 2:
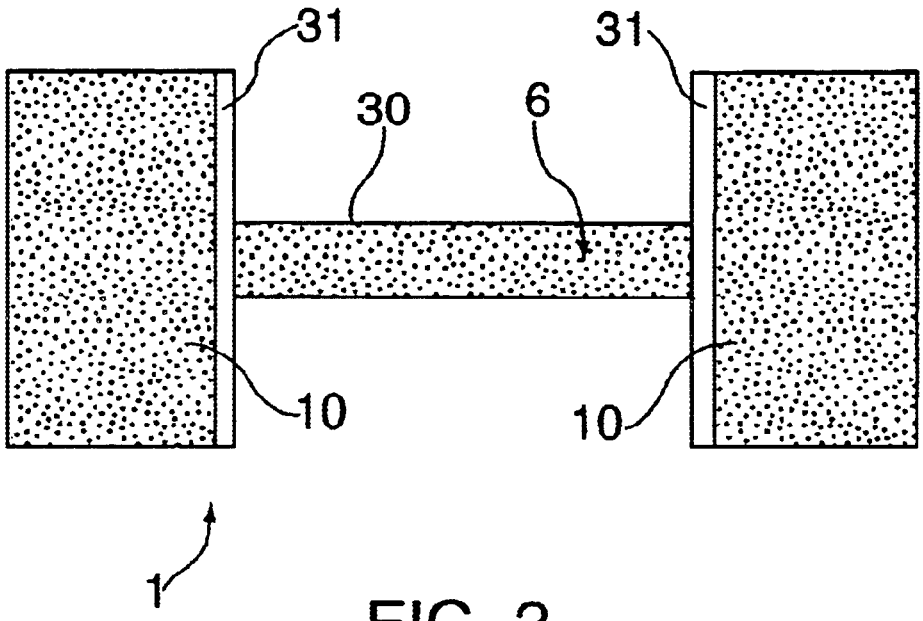
FIG. 2 shows a top view of a bridge igniter according to the first exemplary embodiment of the present invention.
Figure 3:
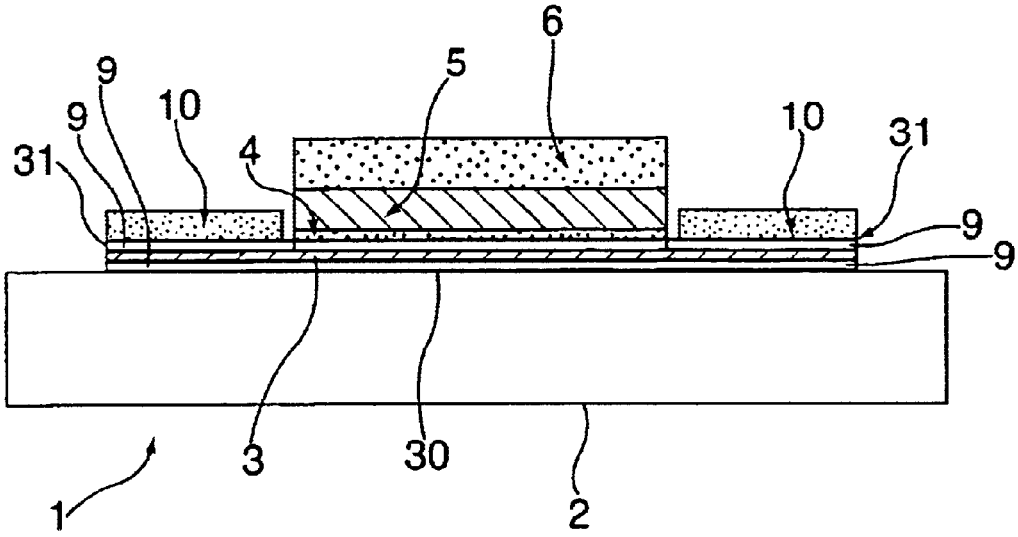
FIG. 3 shows a cross-sectional view of the bridge igniter in FIG. 2 according to the first exemplary embodiment of the present invention.

FIGS. 2 and 3 show, respectively, a top view and a cross-sectional view of a bridge igniter 1 according to the first exemplary embodiment of the present invention.

Contact surfaces 10, such as, for example, gold contact surfaces, are applied to areas 31 of resistance layer 3 to supply electrical energy. Contact surfaces 10 may have dimensions of approximately 300 $\mu$m to 500 $\mu$m.

An insulating layer 4, such as, for example, an oxide layer 4, is disposed on bridge 30 of resistance layer 3. Insulating layer 4 may be formed as a copper oxide or silicon dioxide layer and may have a thickness of approximately 50–100 nm. Other insulating materials may also be used. The dimensions and the material of insulating layer 4 should be selected so as to ensure, on the one hand, good electrical insulation between resistance layer 3 and reactive layer 5, and on the other hand, a good thermal connection between these two layers.

Insulating layer 4 also functions as a diffusion barrier between resistance layer 3 and reactive layer 5. Atoms or ions are thus unable to migrate from one layer into the other and unfavorably change the material characteristics.

As is evident in FIG. 3, a reactive layer 5 that may be made of zirconium or hafnium, for example, and may have a thickness of approximately 500 nm to 1 $\mu$m is arranged on insulating layer 4. The reactive layer 5 selected for this should not be too thin, so that there may be a sufficiently high input of energy.

The arrangement described above may be located on a substrate 2, as is evident in FIG. 3. Substrate 2 may be formed as a silicon substrate, silicon dioxide substrate, ceramic, plastic (polyimide film) or as an integrated circuit. Substrate 2 may have an approximate thickness of 100 $\mu$m to 500 $\mu$m, depending on its material, even greater thicknesses, such as with plastic, may be desirable.

An adhesive layer 9 may be provided between substrate 2 and the resistance layer for better mechanical adhesion.

When bridge igniter 1 is disposed on an integrated circuit 2, electrical energy may be supplied to resistance layer 3 via electrical leads of the integrated circuit. This means that contact areas 10 may no longer be required.

As is evident in FIG. 3, the electrical energy may be supplied via contact areas 10 on resistance layer 3 using a charged capacitor. Because of the electrical resistance of resistance layer 3, the flow of electrical current produces heat due to the Joule-effect, and the resistance layer heats to a specified temperature, which, depending on the material, may be several thousand degrees Celsius.

Insulating layer 4 electrically separates reactive layer 5 from resistance layer 3 in such a manner that reactive layer 5 does not contribute to the total electrical resistance. Nevertheless, insulating layer 4 conveys the Joule-effect heat that is generated in resistance layer 3 to reactive layer 5, producing an exothermic reaction in the latter.

As is recognizable in FIG. 3, reactive layer 5 has a co-reactant 6 on it that initiates the exothermic reaction in reactive layer 5. Co-reactant 6 may be made of copper oxide or manganese oxide and may have a thickness of approximately 1 $\mu$m to 2 $\mu$m.

A pyrotechnic material (not shown), which may be set off by the exothermic reaction of reactive layer 5 with co-reactant 6, is provided on or above co-reactant 6.

Figure 4:
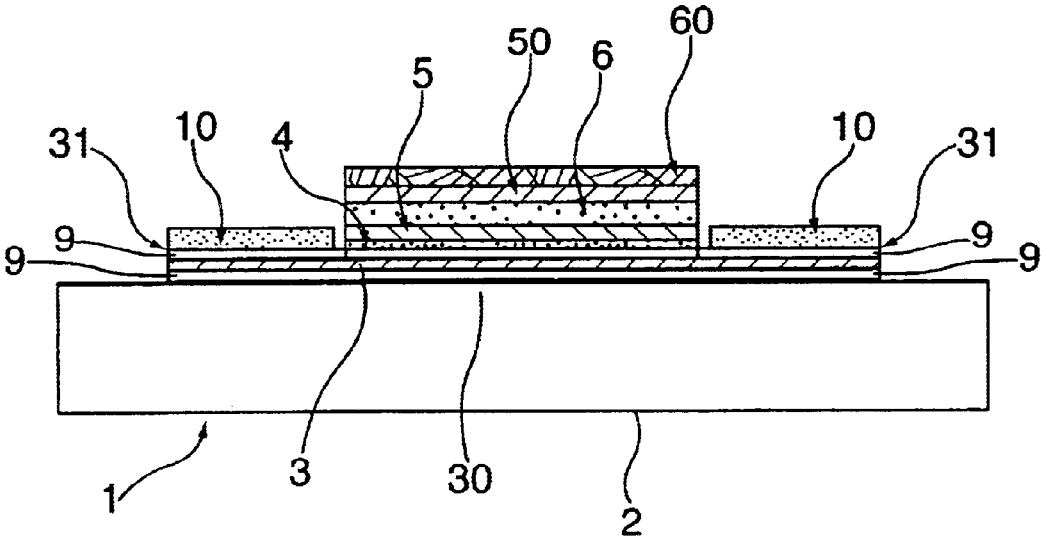
FIG. 4 shows a cross-sectional view of a bridge igniter according to a second exemplary embodiment of the present invention.

FIG. 4 illustrates a cross-section of a bridge igniter according to a second exemplary embodiment of the present invention.

In contrast to the first exemplary embodiment shown in FIGS. 2 and 3, co-reactant 6 has a second reactive layer 50 on it. Second reactive layer 50 in turn has a corresponding second co-reactant 60 on it. This sequence of reactive layers and corresponding co-reactants may be continued as much as desired.

This multi-layer structure enlarges the reaction surface, that is the interface of reactive layers 5, 50 with corresponding co-reactants 6, 60, and increases the reaction speed.

Co-reactants 6, 60 may be produced from the same material as insulating layer 4, such as, for example, as oxide layers of the material of corresponding reactive layers 5, 50.

The pyrotechnic material may be, for example, zirconium-potassium perchlorate (ZPP), which has an ignition temperature of approximately 400° C.

Sample numbers are given below to give a feeling for the corresponding orders of magnitude. Due, for example, to the discharge of a capacitor, a current intensity of approximately 5 amps flows for a period of about 10 $\mu$s through resistance layer 3 having an electrical resistance of several ohms, a temperature of up to 3000° C. being produced via bridge 30 of resistance layer 3.

Although the present invention was described above in terms of exemplary embodiments, it is not limited to them, but rather may be modifiable in numerous ways.

In particular, insulating layers 4 may also be formed as oxide layers of the reactive material and/or of the resistance material.

Furthermore, the multi-layer structure represented in FIG. 4 may be expanded as much as desired.

What is claimed is:

1. A bridge igniter comprising:

a resistance layer having a given electrical resistance and being heatable by an electrical current;

an electrical insulating layer disposed on the resistance layer and having a given thermal conductivity;

a reactive layer disposed on the electrical insulating layer, the electrical insulating layer being configured to transmit heat generated in the resistance layer to the reactive layer to cause the reactive layer to undergo an exothermic reaction; and a pyrotechnic layer disposed above the reactive layer, the pyrotechnic layer being configured to be initiated by the exothermic reaction of the reactive layer.

2. The bridge igniter of claim 1, wherein the electrical insulating layer is formed as an oxide layer.

3. The bridge igniter of claim 1, wherein the electrical insulating layer is formed as one of a copper oxide layer and a silicon dioxide layer.

4. The bridge igniter of claim 1, wherein the electrical insulating layer has a thickness of approximately 50 nm to 100 nm.

5. The bridge igniter of claim 1, wherein the resistance layer includes one of palladium and nickel-chromium.

6. The bridge igniter of claim 1, wherein the reactive layer includes one of zirconium and hafnium.

7. The bridge igniter of claim 1, further comprising:

an adhesive layer disposed under the resistance layer.

8. The bridge igniter of claim 7, wherein the adhesive layer includes a titanium layer.

9. The bridge igniter of claim 1, wherein the electrical insulating layer is configured to function as an adhesive layer between the resistance layer and the reactive layer.

10. The bridge igniter of claim 1, further comprising:

a co-reactant to cooperate with the reactive layer to produce the exothermic reaction.

11. The bridge igniter of claim 10, wherein the electrical insulating layer is configured to function as a co-reactant.

12. The bridge igniter of claim 1, further comprising:

a co-reactant disposed on the reactive layer.

13. The bridge igniter of claim 12, wherein the co-reactant includes an oxide layer.

14. The bridge igniter of claim 12, further comprising:

a multi-layer structure having a plurality of reactive layers and co-reactants in an alternating sequence, the co-reactants being formed as oxide layers of a material of the corresponding reactive layers.

15. The bridge igniter of claim 1, wherein the electrical insulating layer is configured to function as a diffusion barrier between the resistance layer and the reactive layer.

16. The bridge igniter of claim 1, further comprising:

a plurality of electrical contact surfaces connected to the resistance layer to provide electrical power to the resistance layer.

17. The bridge igniter of claim 1, wherein the resistance layer includes gold plates as electrical contact surfaces.

18. The bridge igniter of claim 1, further comprising:

a substrate, wherein the bridge igniter is disposed on the substrate.

19. The bridge igniter of claim 18, wherein the substrate includes one of a silicon substrate, a silicon dioxide substrate, a ceramic substrate, a plastic substrate, and an integrated circuit.

20. The bridge igniter of claim 19, wherein the integrated circuit is configured to supply electrical energy to the resistance layer.

21. The bridge igniter of claim 1, wherein the resistance layer is configured in a bridge shape.

22. A method of forming a bridge igniter, the method comprising:

arranging an electrical insulating layer having a given thermal conductivity to be disposed on a resistance layer having a given electrical resistance;

arranging a reactive layer to be disposed on the electrical insulating layer which is configured to transmit heat generated in the resistance layer by an electric current to the reactive layer to cause the reactive layer to undergo an exothermic reaction; and arranging a pyrotechnic layer to be disposed above the reactive layer, the pyrotechnic layer being configured to be initiated by the exothermic reaction.

23. The method of claim 22, wherein the resistance layer is configured in a bridge shape.

24. A method of initiating a bridge igniter, the method comprising:

arranging an electrical insulating layer having a given thermal conductivity to be disposed on a resistance layer having a given electrical resistance;

arranging a reactive layer to be disposed on the electrical insulating layer which is configured to transmit heat generated in the resistance layer to the reactive layer to cause the reactive layer to undergo an exothermic reaction;

arranging a pyrotechnic layer to be disposed above the reactive layer; and heating the resistance layer by an electric current to generate heat in the electrical insulating layer to cause an exothermic reaction in the reactive layer to initiate the pyrotechnic layer.

25. The bridge igniter of claim 1, further comprising:

an adhesive layer disposed between the resistance layer and one of the insulating layer and the reactive layer.

* * * * *